United States Patent [19]

Bilodeau

[11] Patent Number: 4,982,517

[45] Date of Patent: Jan. 8, 1991

[54] SNAP-TOGETHER PICTURE FRAME

[76] Inventor: Raymond Bilodeau, 28 Sage Ave., Leominster, Mass. 01453

[21] Appl. No.: 520,840

[22] Filed: May 7, 1990

Related U.S. Application Data

[63] Continuation-in-part of Ser. No. 367,145, Jun. 16, 1989, abandoned.

[51] Int. Cl.[5] ..... A47G 1/06

[52] U.S. Cl. ..... 40/155; 40/152

[58] Field of Search ..... 40/155, 159.1, 152

[56] References Cited

U.S. PATENT DOCUMENTS

| | | | |
|---|---|---|---|
| 3,613,280 | 10/1971 | Tuchinsky et al. | 40/155 |
| 4,348,127 | 9/1982 | Hays, Jr. | 40/155 X |
| 4,348,826 | 9/1982 | Reim | 40/155 |
| 4,802,294 | 2/1989 | Baus | 40/155 |

FOREIGN PATENT DOCUMENTS

| | | | |
|---|---|---|---|
| 328359 | 1/1903 | France | 40/155 |

*Primary Examiner*—Laurie K. Cranmer

*Attorney, Agent, or Firm*—William W. Jones

[57] ABSTRACT

The picture frame consists of four rectilinear members which can be joined a right angles to each other to form the complete frame. The members are joined together by interlocking components which are formed in mating parts on the ends of the members. One of the components is a fixed catch which is disposed on one end of the rectilinear member, and the other component is a flexible latch which is disposed on the other end of the member. The rectilinear members are formed in a number of different lengths which are then packaged in groups for forming different size frames. To form the frame, the latch end of one member is simply pushed into the catch end of the adjacent member. The frames can also be manually disassenbled.

6 Claims, 2 Drawing Sheets

SNAP-TOGETHER PICTURE FRAME

This is a continuation-in-part of copending application(s) Ser. No. 367,145 filed on 6/16/89, now abandoned.

This invention relates to picture frames which are manually assembleable from component parts without the need for specialized tools of any kind. More particularly, this invention relates to a picture frame, or a kit for a picture frame, wherein the component parts can be snapped together as a result of mating latch-catch means formed on opposite ends of the frame components.

Picture frames which can be purchased by the customer in an unassembled form are old in the art. Frames of this general type are illustrated in U.S. Pat. Nos. 88,651, granted Apr. 6, 1869, which discloses a frame made up of many small interlocking piees; 2,083,354, granted June 8, 1937, which discloses a picture frame with overlapping corner joints with a hidden dowel connection; 2,521,603, granted Sept. 5, 1950 which discloses a metal picture frame with integral scored folding corners and a tongue-and-slot joint; 2,603,017, granted July 15, 1952; 2,639,530, granted May 26, 1953; and 3,039,217, granted June 19, 1962, all three of which disclose front to back snap fitted frames; and 4,413,035, granted Nov. 1, 1983 which discloses a tongue and groove corner joint for a picture frame. The aforesaid frames rely on friction or adhesive for the securement of the corners of the frame. One advantage to these structures is that they do not require accessory components such as nails, brackets, screws, or the like to secure the corners. The disadvantages attendent to the aforesaid prior art is that positive corner joint engagement is not achieved without glue, or an integral fold joint. Also, it is desirable to have a corner joint which can be disengaged, and then reengaged to frame a different picture.

The frame of this invention can be assembled by the consumer without the use of specialized tools, adhesives, nails, or the like. The frame can also be easily disassembled and reassembled by the consumer. The corner structure of the frame of this invention utilizes a flexible latch arm on one end of each of the frame members, and a fixed catch on the othr end of each of the frame members. The latch arm is mounted by cememting in a protective channel secured by cementing to the frame member, which channel overlies the catch on the adjacent frame member. The frame members are made from molded plastic, and are open in the back so that the latch is accessible for disassembly of the frame. The catch is a simple part which is factory assembled on the frame member by cementing in slots so that the catch cannot slide in the frame member. Picture-engaging fingers which can be easily inserted and removed from the frame by the consumer. The locks are hidden from sight. Each frame member includes a hanger element so that the frame can be hung on a wall in any orientation.

It is therefore, and object of this invention to provide a picture frame assembly which can be assembled by the consumer.

It is a further object of this invention to provide a picture frame assembly of the character described wherein each frame member has mating catch and latch parts formed at opposite ends thereof.

It is an additional object of this invention to provide a picture frame assembly of the character described wherein the frame can be easily disassembled.

These and other objects and advantages of the invention will become more readily apparent from the following detailed description thereof when taken in conjuunction with the accompanying drawings, in which.

Figure 5:
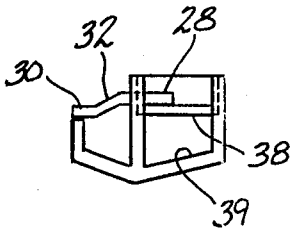
Figure 1:
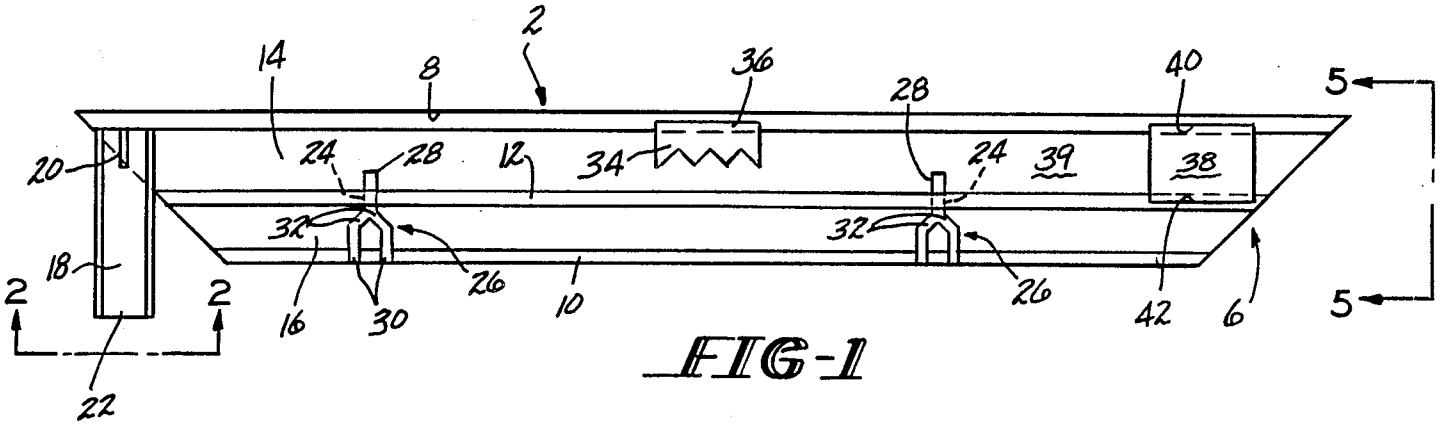
FIG. 1 is an elevational view of the back of a frame member for use in the subject invention.
Figure 2:
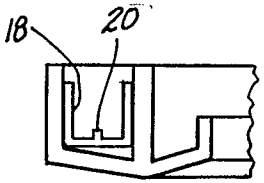
FIG. 2 is a view of one end of the frame member taken along line 2—2 of FIG. 1.
Figure 3:
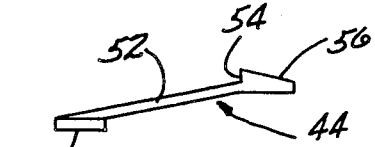
FIG. 3 is a side elevational view of the latch component of the assembly.
Figure 4:
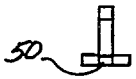
Figure 7:
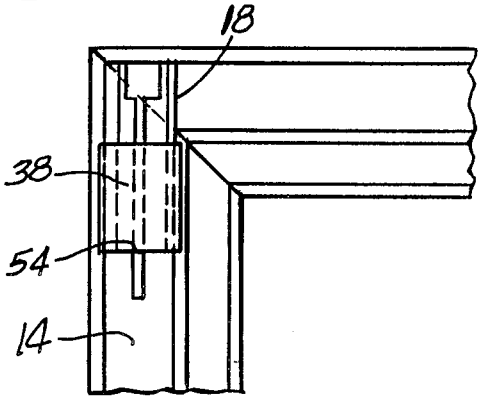
Figure 6:
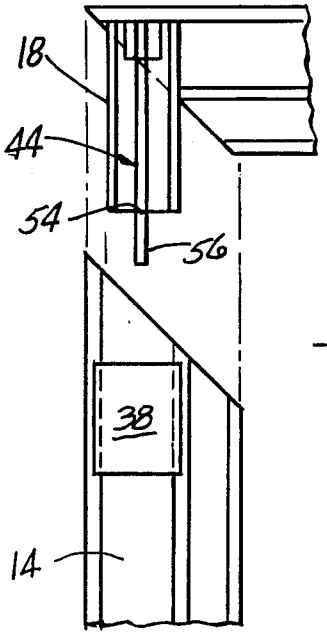

FIG. 4 ia s view of the latch component seen from the right hand side of FIG. 3;

FIG. 5 is a view of the frame member taken along line 5—5 of FIG. 1;

FIG. 6 is a fragmented exploded view of a corner part of a frame formed in accordance with this invention;

FIG. 7 is a fragmented elevational view of a completed corner joint; and

Figure 8:
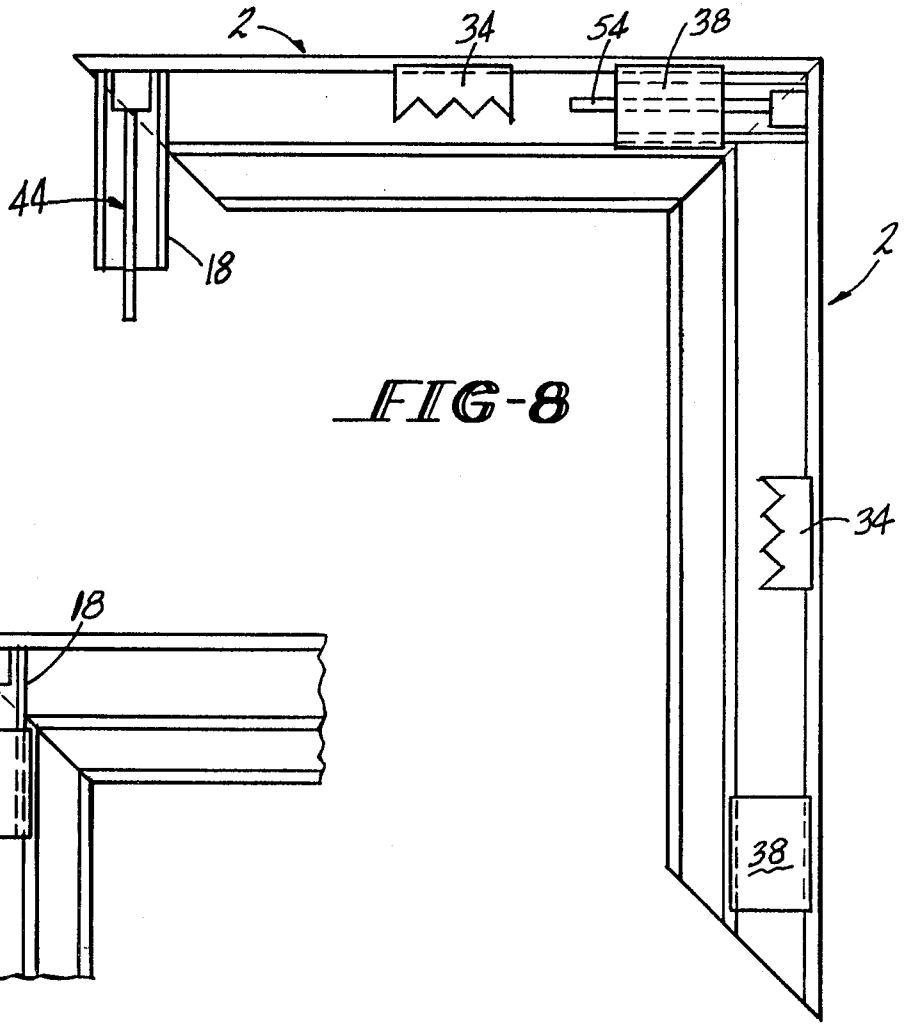

FIG. 8 is an elevational view of two of the frame members joined to form half of a completed frame.

Referring now to the drawings, the frame is composed of four side members 2 which have 45 degree beveled ends 4 and 6. In FIG. 1 the back of the member 2 is shown. The member has an outer flange 8, an inner flange 10, and a medial flange 12. The member 2 is thus divided into two adjacent channels 14 and 16. A U-shaped channel component 18 is mounted on one end of the member 2. The channel component 18 has a rib 20 in it opposite to an open end 22. The flange 12 has holes 24 and 26 drilled in it which receive Y-shaped clips 26. The clips 26 have a stem part 28 which fits tightly in the holes 24, and has fingers 30 which press against the flange 10 to hold a picture in place in the frame by sandwiching the edges of the picture between the fingers 30 and flanges 10. The fingers 30 are connected to the stem 28 by flexible parts 32. A saw tooth hanger component 34 is mounted in a slot 36 in the flange 8. A catch plate 38 is mounted in slots 40 and 42 formed in the flanges 8 and 12, and a latch component 44 is mounted in the channel component 18. The latch 44 has a base part 48 with a central slot 50 which receives the rib 20 in the channel component 18. The latch 44 also includes a springy finger 52 projecting upwardly from the base 48 and terminating in a hook 54. The base 48 is adhered to the channel component 18 whereby the hook 54 can be manually deflected toward the bottom of the channel component 18. A cam surface 56 is formed on the hook 54. Referring to FIGS. 5 and 6, it will be appreciated that the catch plate 38 is spaced apart from the wall 39 sufficiently that the channel component fits snugly between the catch 38 and channel wall 39, and the latch hook 54 projects above the catch plate 38. When the channel component 18 is pushed into the channel 14, the camming surface 56 contacts the catch plate 38 and the latch 44 deflects downwardly until the hook 54 passes the catch plate 38 whereupon the hook 54 springs back up to engage the catch plate 38. The corner thus interlocks firmly as shown in FIG. 7. As seen in FIG. 8, the two connected members 2 are basically identical in construction, except for their length, and they are ready for the next two members to be snapped in place to complete the frame. It will be seen from FIG. 8 that to disassemble the frame, one need merely press the hook 54 downwardly toward the wall 39 to free the hook 54 from the catch plate 38 whereby the latch 44 and channel component 18 can be pulled out of the channel 14.

It will be readily appreciated that the picture frame assembly of this invention can be easily assembled and disassembled without the need of specialized tools, or without any tools at all. The joints are solid and durable, and pictures will be held firmly in place.

Since many changes and variations of the disclosed embodiment of the invention may be made without departing from the inventive concept, it is not intended to limit the invention otherwise than as required by the appended claims.

What is claimed is:

1. A one piece picture frame component for forming one entire side of a picture frame, said component comprising: an elongated member of a length which substantially conforms to the length of one side of a picture to be framed, said member having opposed beveled ends, and inner, medial and outer flanges which form two adjacent channels on a back side of the member, which channels have open ends formed at said opposed beveled ends; a U-shaped channel component permanently secured in one of said elongated member channels and extending therefrom at right angles to the axis of elongation of the elongated member, said channel component having a transverse outer dimension substantially equal to the transverse inner dimension of said one of said elongted member channels; a resilient latch element permanently mounted in said channel component, said latch element extending toward an open end of said channel component, and said latch element having a hook part facing toward said elongated member, and a camming surface facing away from said elongated member; and a catch plate permanently mounted on said medial flange and extending across said one of said elongated member channels at an end thereof opposite said channel component.

2. In combination with the picture frame component of claim 1, clip means removably mounted on said medial flange and extending over and biased onto said inner flange for engaging and pressing an edge of a mounted picture against said inner flange to hlod the picture in place in the picture frame.

3. The picture frame component of claim 1 further comprising hanger means mounted on said outer flange for engagement with a nail to hold the picture frame in place on a wall.

4. An easily assemblable and disassemblable picture frame, said frame comprising:

(a) top, bottom, left hand and right hand one piece elongated frame members each of which is disposed at right angles to adjacent ones of said frame members, each of said frame members having a back side therof formed with outer, medial and inner flanges forming adjacent open-ended inner and outer channels therein which flanges and channels extend lengthwise of the frame members;

(b) abutting forty five degree beveled ends on each of frame members forming right angle corners on said frame whereby said inner and outer channels in each frame member communicate with the inner and outer channels in each adjacent frame member;

(c) a channel member permanently mounted in one end of one of said inner and outer channels on each frame member, and extending at right angles into the corresponding channel on an adjacent frame member to be snugly received therein;

(d) a catch member permanently mounted in said corresponding channel in each adjacent frame member, said catch member overlying the channel member which extends into said corresponding channel; and (e) a latch member permanently mounted in each of said channel members, each of said latch members engaging the catch members overlying the channel members to hold the frame members together and resist pulling of the channel members out of said corresponding channels.

5. The picture frame of claim 4 wherein each latch member is formed with a leading cam surface and a flexible stem part, whereby each latch member will deflect past said catch members through engagement of said catch members by said latch cam surfaces when said channel members are pushed into said corresponding channels during assembly of the frame.

6. The picture frame claim 5 wherein said channels and channel members are open from the back of the frame whereby said latch members are accessible to allow manual release of the latch members from the catch members.

* * * * *